US005850994A

United States Patent [19]

Wilson

[11] Patent Number: 5,850,994

[45] Date of Patent: Dec. 22, 1998

[54] SANDBAG HOLDING FRAME

[76] Inventor: Kenneth M. Wilson, 10673 Foix Ave., Norwalk, Calif. 90650

[21] Appl. No.: 644,603

[22] Filed: Apr. 5, 1996

[51] Int. Cl.[6] ..... A63B 55/04

[52] U.S. Cl. ..... 248/97; 248/175

[58] Field of Search ..... 248/95, 97, 99, 248/101, 100, 175, 146, 148, 153; 383/33

[56] References Cited

U.S. PATENT DOCUMENTS

| | | | |
|---|---|---|---|
| 130,051 | 7/1872 | Hollidge . | |
| 575,902 | 1/1897 | Nicholas . | |
| 744,338 | 11/1903 | Hall . | |
| 2,925,235 | 2/1960 | Jaros | 248/153 |
| 3,095,172 | 6/1963 | Dwyer | 248/97 |
| 3,161,391 | 12/1964 | Bahnsen | 248/99 |
| 3,556,395 | 1/1971 | Herman | 248/97 X |
| 3,598,350 | 8/1971 | Kaufman | 248/97 |
| 3,655,157 | 4/1972 | Dalton | 248/97 |
| 3,695,565 | 10/1972 | Hodges | 248/97 |
| 3,768,763 | 10/1973 | Hembree | 248/97 |
| 3,960,351 | 6/1976 | Coetzee | 248/101 |
| 4,723,742 | 2/1988 | Krauss | 248/97 |
| 4,981,274 | 1/1991 | McVay et al. | 248/99 |
| 5,107,666 | 4/1992 | Rahtican | 248/101 X |
| 5,116,138 | 5/1992 | Macsenti et al. | 383/33 |
| 5,395,147 | 3/1995 | Brown et al. | 248/101 X |
| 5,397,085 | 3/1995 | Spagnolo | 248/97 |
| 5,575,315 | 11/1996 | Wengert | 141/109 |

*Primary Examiner*—Leslie A. Braun
*Assistant Examiner*—Anita M. King

[57] ABSTRACT

A frame for holding a sandbag for facilitating the filling of a sandbag by one person. The frame has a generally rectangular support member which is held at an angle to the ground so that the top of the opening is higher than the bottom of the opening. The open end of a sandbag is inserted through the support member and folded back over it. Then sand can be easily shoveled into the open end of the sandbag preferably by resting the shovel on the bottom of the generally rectangular support member and merely lifting the handle. When the sandbag is full the top is removed from the generally rectangular support member and tied in a conventional manner and another bag is placed through the opening for filling.

9 Claims, 2 Drawing Sheets

SANDBAG HOLDING FRAME

BACKGROUND OF THE INVENTION

The field of the invention is broadly material handling and more specifically the filling of sandbags. During times of impending flooding it is almost always necessary for volunteers to fill numerous sandbags to provide a temporary wall to deflect the flow of rising water. In practice, empty sandbags and sand are typically deposited at a volunteer worksite. One volunteer bends over and holds the open end of the sandbag so that a second person may shovel sand into it. The sandbag holding process is, of course, tedious and requires a second person.

Numerous structures have been devised for holding bags with perhaps the most common holder today used for supporting plastic grocery bags for holding garbage. Such bag holders invariably have a horizontal top which makes it very difficult to use for shoveling a heavy material such as sand into the supported bag. One such bag holder is shown in U.S. Pat. No. 130,051 which utilizes a hoop over which the bag is supported. Another early bag support is shown in U.S. Pat. No. 575,902. Once again, the top of the bag is horizontal. A bag holding rack is shown in U.S. Pat. No. 3,095,172 which likewise has a horizontal opening. Another bag holder is shown in U.S. Pat. No. 3,556,395 as well as in U.S. Pat. No. 3,598,350. Lastly, a trash bag holder is shown in U.S. Pat. No. 3,768,763. None of these holders are capable of assisting a person to fill a bag with heavy material such as sand by use of a conventional shovel. That is, in order to fill any of the supported bags of the above-listed patents, one would have to lift a sand filled shovel above the top of the bag and tip the shovel over allowing the sand to fall downwardly into the bag. This, as will be explained below, is a tedious and inefficient process.

BRIEF SUMMARY OF THE INVENTION

It is an object of the present invention to provide a frame for holding a sandbag to permit one person to fill the sandbag without the necessity of a second person to hold the bag.

The present invention is for a frame for holding a sandbag for facilitating the filling of the bag by one person. The frame has a front, a back, a right side and a left side. The frame comprises a generally rectangular support member fabricated from an elongated material. The support member has a top near the back of the frame, right and left sides and a bottom near the front of the frame. An imaginary line formed between the top and bottom of the support member form an angle between 15° and 45° with respect to the horizontal when the frame is supported on a horizontal surface. At least two support arms hold the support member and are affixed to a base which is supported by the ground. Preferably the support arms are held to the sides near the bottom of the support member but spaced rearwardly therefrom to facilitate the attachment of a sandbag. Preferably the member is supported at about 30° from the horizontal, angled toward the front. The frame may be fabricated from rod and the support arms and the base may be a single bent rod. The process for using the frame of the present invention comprises placing the bottom end of a sandbag down through the center of the opening of the rectangular support member and folding the top edges of the bag outwardly and downwardly over the support member. This provides an angled opening for insertion of sand. Next, a shovel is filled with sand and the bottom of the shovel is rested on the portion of the sandbag which is wrapped over the bottom of the generally rectangular support member. As the handle of the shovel is raised the sand falls into the sandbag. The support member is near enough to the ground so that a portion of the sandbag is supported by the ground.

FIG. is a top view thereof.

Figure 1:
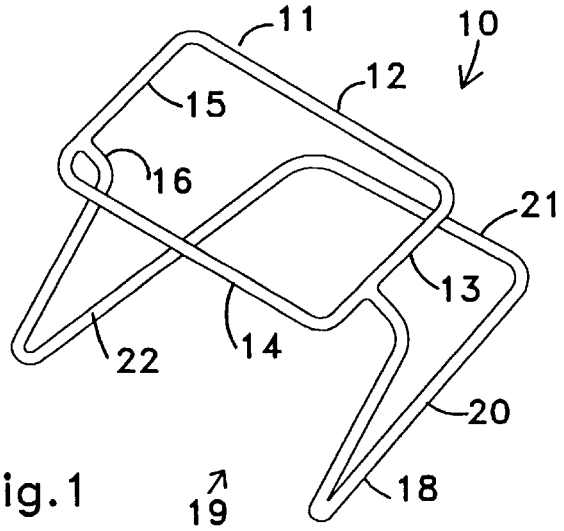
FIG. 1 is a perspective view of the frame for holding a sandbag of the present invention.
Figure 4:
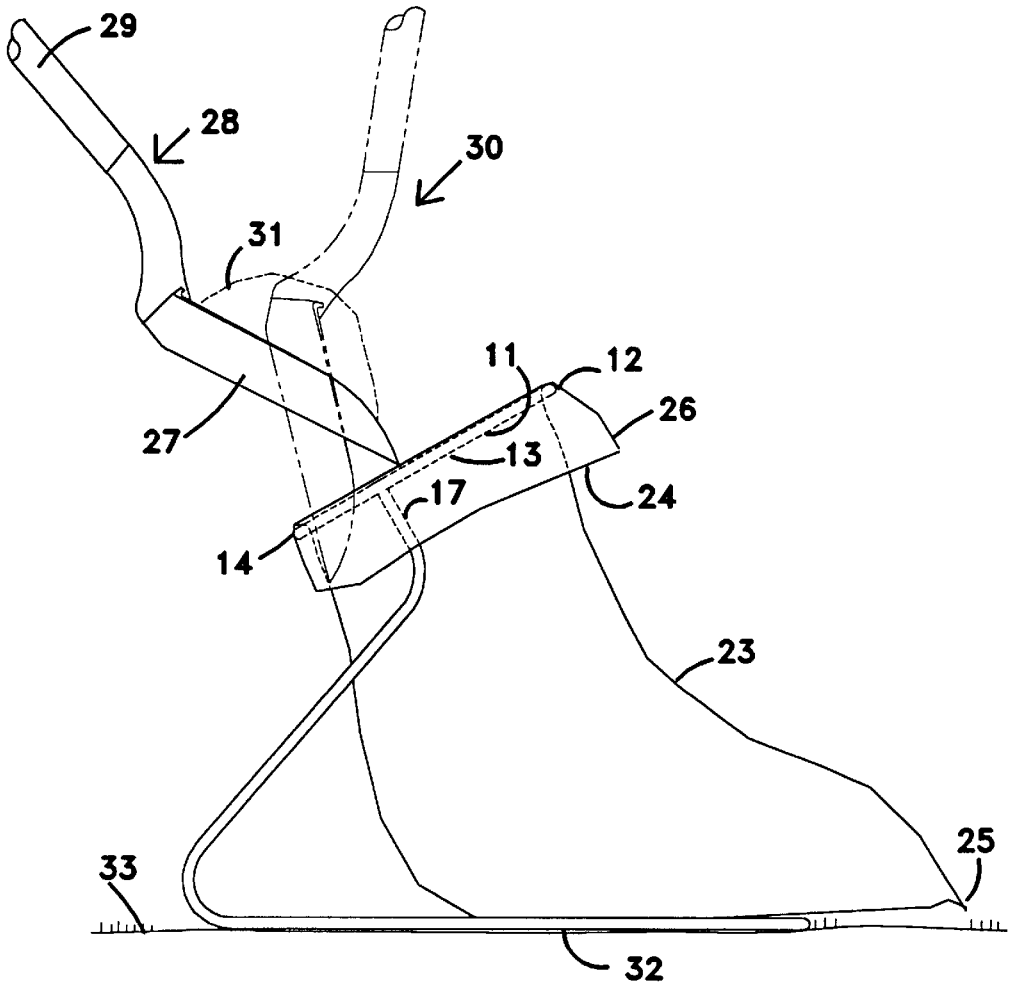

FIG. 4 is a side view of the frame of FIG. 1, further including a sandbag shown in phantom view and a shovel depositing sand into the sandbag.

DESCRIPTION OF THE PREFERRED EMBODIMENTS

The frame for holding a sandbag of the present invention is shown in perspective view in FIG. 1 and indicated generally by reference character 10. Frame 10 has a generally rectangular support member 11 which has a top 12, a right side 13, a bottom 14 and a left side 15. This generally rectangular support member 11 is held by a pair of support arms 16 and 17 which extend downwardly to a base 18. The frame itself has a front 19, a right side 20, a back 21 and a left side 22.

Figure 2:
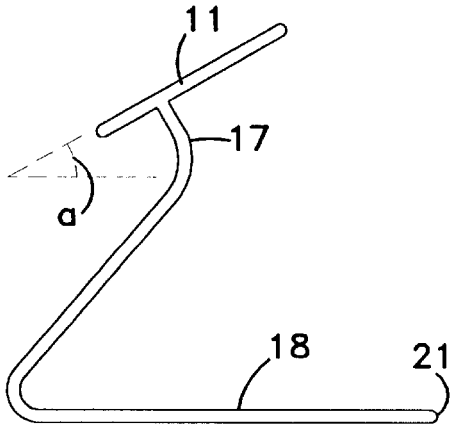
FIG. 2 is a side view thereof.
Figure 3:
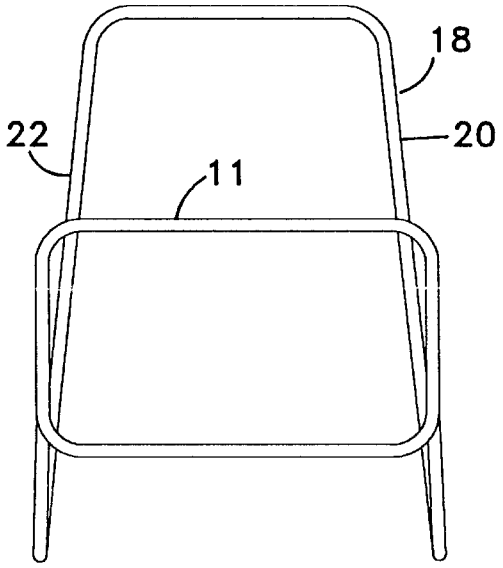

The frame is shown in side view in FIG. 2 where it can be seen that the generally rectangular support member 11 is supported at an angle indicated by reference character "a" to the horizontal. The base 18 is shown in a horizontal position in FIG. 2. The frame is shown in top view in FIG. 3 is where it can be seen that the right side and left side of the frame preferably slightly converge which permits a nesting of a plurality of frames for storage. In use, typically an emergency crew would carry many frames stacked together and distribute them at various sandbag filling points.

The use of the frame is shown in FIG. 4 where a sandbag 23 is held by the frame. Sandbag 23 has an open top 24 and a sewn bottom 25. The lowermost part of sandbag 23 is indicated generally by reference character 32 and rests on the ground surface 33. The open top 24 has been folded over the generally rectangular support member 11 and is sufficiently supported thereby so that sand may be placed therein. The positioning of the support arms 16 and 17 with respect to the sides 13 and the bottom 14 is an important feature of the present invention. The support arms 17 can be seen in FIG. 4 to be nearer bottom 14 than top 12, but to be spaced from bottom 14. In this way the overhanging portion 26 of sandbag 23 is able to move around bottom 14 and more securely be held thereby than if the support arm were directly along bottom 14.

The frame of the present invention greatly facilitates the filling of a bag. First of all, it eliminates the need of a second person to hold the bag open. Of equal importance, however, is the angled position of the generally cylindrical support member 11. By angling this opening, the worker can easily throw sand into the opening from the blade 27 of shovel 28 while holding handle 29. If the sand or dirt is wet and tends to stick on the shovel blade, throwing it into the opening is almost impossible. However, with the positioning of bottom 14 at a point relatively close to ground 33 the worker can place the blade 27 on bottom 14 and tilt it upwardly as shown in phantom view 30 in FIG. 4. The sand, dirt or other material 31 then falls into bag 23.

When the bag is sufficiently full, the open top 24 is pulled back over and through member 11 and tied. It can be removed rearwardly or over either side. Typically, the base will become somewhat embedded in the sand, but the design of the frame is such that bag removal is very easy and doesn't require the lifting of the filled sand bag.

Advantageously, the frame of the present invention is made from solid rod or thick walled tubing. It has been found that ½" diameter solid rod makes a very sturdy frame which is easily capable of supporting the weight of a filled shovel blade. Two lengths of rod may be bent forming the generally rectangular support member 11 and the other forming the support arms, sides and back of the frame.

The angle "a" of the top member 11 is a very important feature of the present invention. It should be between 15° and 45° and preferably about 30°. If the angle exceeds about 45° the worker is required to throw the sand into the bag. If the angle is less than about 15° the worker is required to lift the sand higher and is prevented from throwing the sand into the bag. The length of the bottom and top should be such that blade 27 of the shovel fits completely into the opening. A spacing between the right and left sides 13 and 15 of about 1 ¾' has been found satisfactory with a length of the sides of about 7¾". Sandbags are not completely uniform and this size is small enough to accommodate most bags available for this use. Slightly larger bags also work because the open top 24 can be folded over member 11 and the material of the bag is stiff enough to hold it since the bag itself is largely supported by the ground.

While the frame of the present invention has been described largely in the context of filling sandbags, it of course can be used for filling other materials which may be scooped up with a shovel. Although the design appears simple, it greatly facilitates the difficult job of sandbag filling. After a flood or other emergency the frames can be picked up for use during the next emergency.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A frame designed to rest on the ground for holding a sandbag for facilitating the filling of said sandbag by one person, said frame having a front, a back and a right side and a left side, said frame comprising:

a generally rectangular support member fabricated from an elongated material, said generally rectangular support member having a top near the back of the frame but forward thereof, a right side, a bottom near the front of said frame and a left side, a line formed between said top and bottom as viewed from the left side of said member forming an angle of between 15 and 45 degrees with respect to the horizontal when the frame is supported with its bottom resting on a horizontal surface;

at least two support arms affixed to said generally rectangular support member; and a base adapted to rest on a ground surface, said base lying affixed to said at least two support arms so that when the base is resting on the ground surface, the bottom of said rectangular support member is above the ground surface, whereby the frame may be supported by said base on the ground and the generally rectangular support member being positioned so that it is angled to the front of the frame with its bottom adapted to be above the ground and available for affixing the open end of said sandbag therearound said support arms being affixed to said generally rectangular support member so that said bottom of said generally rectangular support member cannot touch said base.

2. The frame for holding a sandbag of claim 1 wherein one of said at least two support arms is affixed to said right side of said generally rectangular support member and another of said at least two support arms is affixed to said left side of said generally rectangular support member.

3. The frame for holding a sandbag of claim 2 wherein there are two support arms and each support arm is affixed to its respective side near the bottom of said generally rectangular support member but spaced away from the bottom to facilitate the attachment of a sandbag opening.

4. The frame for holding a sandbag of claim 1 wherein said line formed between said top and bottom is at about 30 degrees from the horizontal.

5. The frame for holding a sandbag of claim 1 wherein there are two support arms and the support arms and the base are formed from a single member.

6. The frame for holding a sandbag of claim 5 wherein each support arm extends first downwardly from a point of attachment to the sides of said generally rectangular support member, then angled forwardly and downwardly, then curved toward the back of the frame and rearwardly to form two horizontal legs and then curved inwardly to meet and form the back of the frame so that the frame is open in the front.

7. The frame for holding a sandbag of claim 1 wherein said frame is fabricated from a solid rod.

8. The frame for holding a sandbag of claim 7 wherein said solid rod is about one-half inch in diameter.

9. The frame for holding a sandbag of claim 1 further including a sandbag having an unfilled height, a width, an open top and a closed bottom and wherein said generally rectangular support member is positioned so that the closed bottom is resting on the ground when the frame is resting on the ground and when the open top of the sandbag is wrapped over said generally rectangular support member.

* * * * *